United States Patent [19]

Nettesheim et al.

[11] Patent Number: 4,594,943

[45] Date of Patent: Jun. 17, 1986

[54] INK STAMP

[75] Inventors: Daniel R. Nettesheim, Waukesha; Daniel D. Nettesheim, New Berlin; John H. Carpentier, Milton, all of Wis.

[73] Assignee: Schwaab Inc., Milwaukee, Wis.

[21] Appl. No.: 694,593

[22] Filed: Jan. 24, 1985

[51] Int. Cl.[4] ..... B41K 1/00

[52] U.S. Cl. ..... 101/327; 101/368; 101/405

[58] Field of Search ..... 101/368, 327, 405

[56] References Cited

U.S. PATENT DOCUMENTS

| | | | |
|---|---|---|---|
| 2,900,902 | 8/1959 | Becker | 101/368 |
| 2,966,116 | 12/1960 | Harris et al. | 101/368 |
| 3,832,947 | 9/1974 | Funahashi | 101/327 |
| 3,952,653 | 4/1976 | McFarland | 101/327 |
| 4,022,127 | 5/1977 | Carlsson et al. | 101/327 |
| 4,172,419 | 10/1979 | Munyon | 101/379 |
| 4,203,362 | 5/1980 | Underwood | 101/327 |
| 4,362,101 | 12/1982 | Aherns | 101/327 |

FOREIGN PATENT DOCUMENTS

| | | | |
|---|---|---|---|
| 2912985 | 10/1979 | Fed. Rep. of Germany | 101/368 |

*Primary Examiner*—Edgar S. Burr
*Assistant Examiner*—Tonya Eckstine
*Attorney, Agent, or Firm*—Andrus, Sceales, Starke & Sawall

[57] ABSTRACT

A manually operated ink stamp having a base with an open bottom and an aperture in the top wall. A box-like frame having an open bottom is disposed within the base and has a lower edge. A sleeve is connected to the upper portion of the frame and extends upwardly through the aperture in the base and is connected to a handle. The handle and frame are biased upwardly with respect to the base by a compression spring that is interposed between the handle and the base. Located within the frame is a die holder that carries a printing die impregnated with ink, and the lower surface of the die projects downwardly beyond the lower edge of the frame. A threaded adjustment is provided for adjusting the vertical position of the die holder and die with respect to the frame. Applying a force to the handle causes downward movement of the frame and die holder to bring the die into contact with the material to be printed and contact of the lower edge of the frame with the material provides a stop to limit further compression of the die and control the printing impression.

10 Claims, 5 Drawing Figures

INK STAMP

BACKGROUND OF THE INVENTION

In the conventional manually operated ink stamp, a printing die, which is impregnated with ink, is mounted on the lower surface of a die holder contained within an outer housing or base. A stem connected to the upper surface of the die holder projects upwardly through an opening in the base and carries a handle. The die holder is biased to a raised position, in which the die is located out of contact with the material to be printed, by a compression spring which is positioned around the stem and is interposed between the base and the handle. By applying a manual force to the upper end of the handle, the spring force will be overcome to move the die downwardly into contact with the material to be printed.

When using ink stamps having a microporous die preimpregnated with ink, proper control of the stamping pressure is critical. If the stamping pressure is too great, an unnecessarily large quantity of ink will be expelled from the die and the printing impression may be overly dark or smudged. On the other hand, if the stamping pressure is too light, an insufficient quantity of ink will be discharged from the die and the printing impression will be light and illegible.

In the past, various attempts have been made to provide an adjustment for the stamping pressure. In one such device, as illustrated in U.S. Pat. No. 4,022,127, a two part bushing is located below the handle and acts as a stop to limit vertical depression of the handle. By threaded adjustment of the bushing, the position of the stop can be varied to thereby vary the distance which the handle may be depressed.

U.S. Pat. No. 4,203,362, also shows an adjusting mechanism which will limit the stroke of travel of the handle to thereby vary the printing impression.

In the U.S. Pat. No. 4,362,101, an adjusting mechanism is provided which will adjust the position of the die holder and the die relative to the base or housing. By varying the position of the die within the base, the printing impression can be controlled.

With any ink stamp, there are certain areas on the die which are blank or free of printing. If a heavy or excessive force is applied to the handle, these non-printing areas can contact the paper or other material to be printed, leaving a smudge on the paper. Because of this, it has been the practice to seal the non-printing areas on the die by applying a plastic coating to these areas. As the sealing operation is done manually, it is time consuming and increases the overall cost of the stamp.

SUMMARY OF THE INVENTION

The invention is directed to a manually operated ink stamp having an improved adjusting mechanism which insures that a uniform printing impression will be made regardless of the magnitude of the force applied to the handle. In accordance with the invention, the ink stamp includes a base or housing having an open bottom and an aperture in the top wall. A generally box-shaped frame having an open bottom is positioned within the base, and a sleeve extends upwardly from the frame through the aperture in the base and is connected to a handle. The handle and frame are biased upwardly relative to the base by a spring which is interposed between the handle and the base.

Located within the frame is a die holder that carries a printing die formed of microporous plastic having ink impregnated therein. In its raised position, the lower surface of the die projects downwardly beyond the lower edge of the frame. Extending upwardly from the die holder is a stem which extends through the sleeve in the frame and is threaded to the handle. Through the threaded adjustment, the position of the die holder and die can be varied relative to the frame.

By applying a downward force to the handle, the frame and die holder are moved downwardly to bring the die into contact with the material to be printed, and the engagement of the lower edge of the frame with the material provides a stop to restrict further downward movement of the die. Due to the engagement of the lower edge of the frame with the material to be printed, compression of the die is limited, so that a uniform printing impression will be obtained regardless of the force applied to the handle.

As the printing impression will be uniform regardless of the force applied to the handle, it is not necessary to seal non-printing areas on the die and this substantially reduces the overall cost of the stamp.

As a further advantage, a uniform imprint is obtained, even though the force may be applied nonaxially or to the side of the handle.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
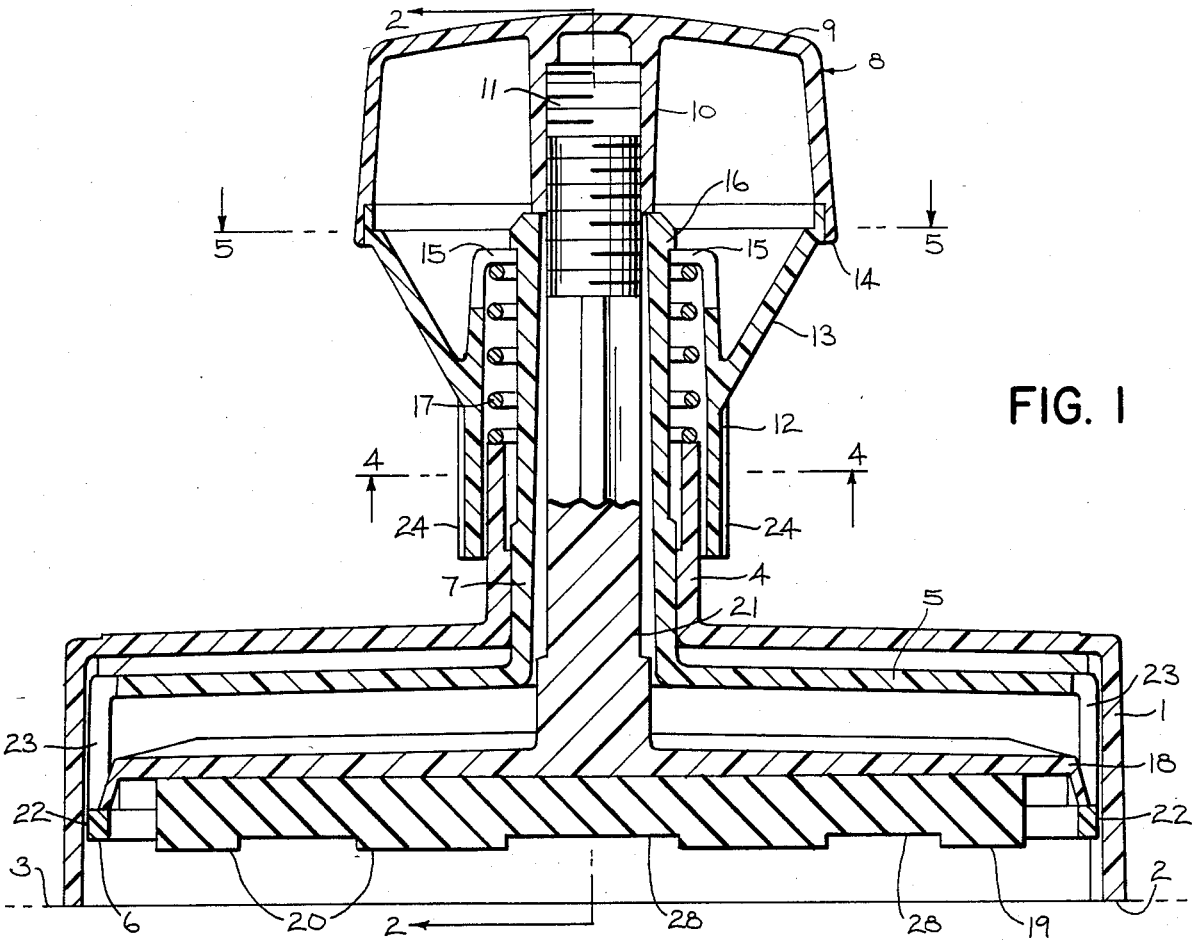
FIG. 1 is a vertical section of the ink stamp of the invention.
Figure 3:
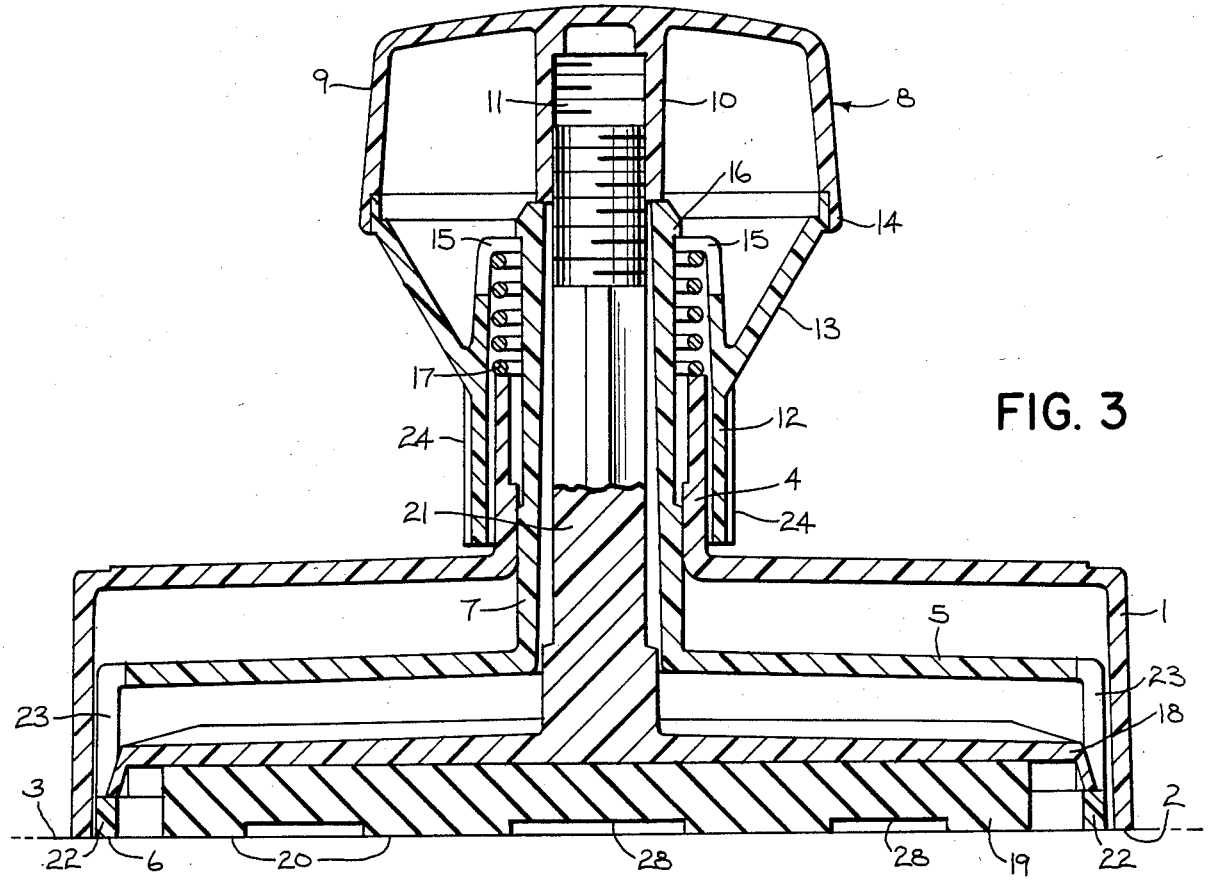
FIG. 3 is a view similar to FIG. 1 showing the die in a lowered position and engaging the material to be printed.

The ink stamp of the invention includes an outer base or housing 1 having an open bottom bordered by a generally rectangular bottom edge 2 that is adapted to rest on a surface that supports the material 3 to be printed. Extending upwardly from the central portion of base 1 is a tubular member 4.

Figure 2:
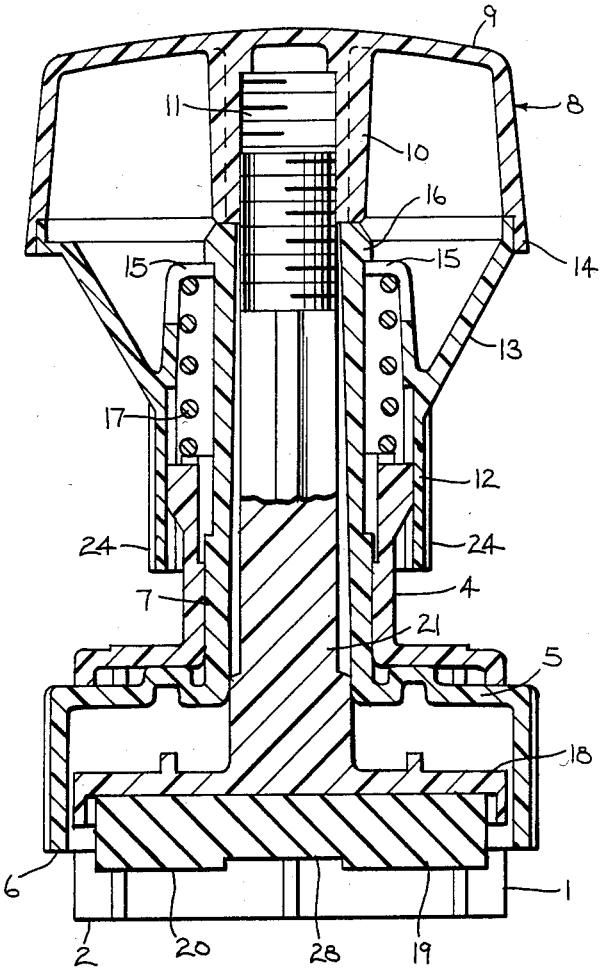
FIG. 2 is a section taken along line 2—2 of FIG. 1.

Positioned within base 1 is a generally rectangular box-shaped frame 5 having an open bottom which is bordered by a lower edge 6. A sleeve 7 extends upwardly from the central portion of frame 5 and is connected to handle 8. As shown in FIG. 2, frame 5 has a greater width than base 1 so that the sides of the frame project outwardly through openings in the sides of the base. However, in other circumstances the frame 5 can be confined entirely within base 1.

Figure 4:
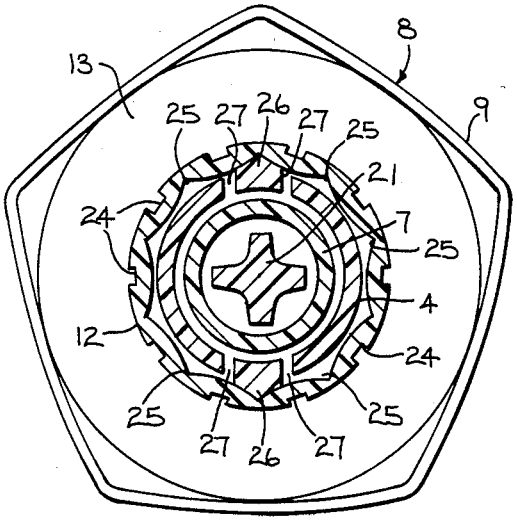
FIG. 4 is a horizontal section taken along line 4—4 of FIG. 1.
Figure 5:
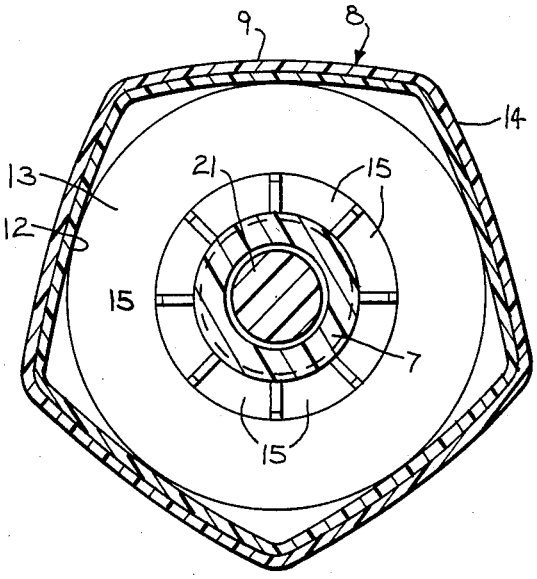
FIG. 5 is a section taken along line 5—5 of FIG. 1.

As best illustrated in FIGS. 1, 4 and 5, handle 8 includes a five sided dome-shaped head 9 and a central hub 10 extends downwardly from the inner surface of head 9 and contains a threaded bore 11. As shown in FIGS. 1 and 2, handle 8 also includes a skirt 12 having an upwardly tapered portion 13 that is attached to the peripheral flange 14 of head 9.

As shown in FIG. 5, the upper inner portion of skirt 12 is formed with a plurality of inwardly directed fingers or flanges 15 which are adapted to engage a shoulder 16 formed on sleeve 7.

To bias the handle 8 and frame 5 upwardly relative to base 1, a compression spring 17 is interposed between the fingers 15 and the upper edge of tubular member 4 on base 1. The force of spring 17 will urge the handle and frame 5 to a raised position, as shown in FIG. 1.

Fingers 15, being flexible, aid in the assembly of the handle 8 to sleeve 7. During assembly, the skirt 12 containing spring 17 is slipped downwardly over sleeve 7 and the fingers 15 deflect outwardly as they pass over shoulder 16 and snap into position beneath the shoulder. Head 9 can then be attached to skirt 12. In the assembled condition, shoulder 16 is trapped between the lower end of hub 10 and fingers 15 so that the handle can rotate but cannot move axially relative to sleeve 7 and frame 5.

Positioned within frame 5 is a die holder 18 that carries a microporous plastic die 19 impregnated with ink. The lower surface of die 19 carries indicia or printing indicated by 20 which projects downwardly beyond the lower edge 6 of frame 5 when the frame and die holder are in the raised position, as shown in FIG. 1.

A vertical stem 21 extends upwardly from die holder 18 through sleeve 7 and the upper end of stem 21 is threaded in bore 11. By rotating handle 8, the position of the die holder 18 and die 19 relative to frame 5 can be varied to compensate for shrinkage of die 19 during use, or to vary the printing impression.

To guide the die holder in vertical movement relative to frame 5 during adjustment, tabs 22 are formed on opposite ends of die holder 18 and ride within guideways 23 formed in frame 5.

The outer surface of skirt 12 can be provided with knurls 24 or other surface deviations.

As best shown in FIG. 4, the inner surface of skirt 12 is formed with a plurality of generally V-shaped grooves 25, which are spaced circumferentially around the skirt and the grooves are adapted to be engaged by generally V-shaped projections 26 on the tubular portion 4 of base 1. Each projection 26 is bordered by a pair of vertical slots 27 which extend to the upper end of tubular member 4 and the slots provide the projections 26 with resiliency, so that on rotation of the skirt 12 and handle 8, the projections will be deformed inwardly and then snap into the next succeeding groove 25 to retain the handle in that position. In practice, the indexing of the projections 26 into the next succeeding notch 25 will raise or lower the die approximately 0.005 inch.

During use of the stamp, the ink will be expelled from the die 19, causing the die to shrink slightly and this shrinkage can be compensated for by adjusting the position of the die 19 relative to frame to provide the desired printing impression.

With the ink stamp of the invention, the engagement of the lower edge 6 of frame 5 will limit the printing stroke, so that a uniform impression will result regardless of the magnitude of the force applied to the handle. By preventing excessive compression of the die, the non-printing areas are prevented from contacting the material to be printed and thus the nonprinting or blank areas 28 need not be sealed.

The construction of the invention also insures that uniform pressure is applied throughout the area of the die to the material to be printed, even though the force applied to the handle may be at an angle to the vertical.

While the drawings illustrate frame 5 as being rectangular in shape, it is contemplated that the frame 5, as well as the die holder 18 and die 19, can take different configurations. Further, the lower edge 6 of frame 5 need not extend continuously around the entire periphery of the frame 3, but may be discontinuous.

Various modes of carrying out the invention are contemplated as being within the scope of the following claims particulary pointing out and distinctly claiming the subject matter which is regarded as the invention.

I claim:

1. A manually operated ink stamp, comprising a base having an open bottom bordered by a bottom edge and having a top wall with an opening therein, a frame disposed within the base, said frame having an open bottom bordered by a lower edge, a handle connected to the frame, means for preventing relative axial movement between the frame and said handle, biasing means for urging the frame and the handle to a raised position relative to the base, a die holder disposed within the frame, a printing die mounted on the die holder, said die having a lower surface bearing indicia and projecting downwardly beyond the lower edge of the frame when the frame is in the raised position, and adjusting means interconnecting the handle and the die holder for adjusting the vertical position of the die holder and die relative to the frame, a downward force applied to the handle causing downward movement of the frame and die holder relative to the base to bring said die into contact with a material to be printed and engagement of the lower edge of said frame with said material providing a stop to limit downward movement of said die.

2. The ink stamp of claim 1, wherein said lower edge is generally rectangular in shape.

3. The ink stamp of claim 1, wherein said biasing means includes a spring disposed between the base and said handle.

4. The ink stamp of claim 1, wherein said adjusting means comprises a stem on said die holder which extends upwardly through said opening in the base, the upper end of said stem being threadedly engaged with said handle, relative threaded adjustment between said stem and said handle moving said die holder and die relative to said frame.

5. The ink stamp of claim 1, wherein said frame includes a sleeve extending upwardly through said opening in said base and connected to said handle.

6. A manually operated ink stamp, comprising a base having an open bottom bordered by a bottom edge and having a top wall with an opening therein, a frame disposed within the base, said frame having an open bottom and bordered by a lower edge, said frame also including a sleeve extending upwardly through said opening in the base, a handle connected to said sleeve, means for preventing relative axial movement between said sleeve and said handle, biasing means for urging the frame and the handle to a raised position relative to said base, a die holder disposed within the frame, a printing die pre-impregnated with ink mounted the die holder and having a bottom surface bearing indicia and projecting downwardly beyond the lower edge of said frame when said frame is in a raised position, and adjusting means for adjusting the vertical position of the die holder and die relative to said frame, a force applied to said handle causing downward movement of said frame and die holder to bring said die into contact with a material to be printed and engagement of the lower edge of said frame with said material limiting further downward movement of said die.

7. The ink stamp of claim 6, wherein said die holder includes an upstanding stem disposed within said sleeve, the upper end of said stem projecting beyond the upper end of said sleeve and being connected to said handle.

8. The ink stamp of claim 7, wherein said adjusting means comprises a threaded connection between the projecting end of said stem and said handle.

9. The ink stamp of claim 6, wherein said adjusting means includes a tubular member bordering the opening in said base and disposed radially outward of said sleeve, said handle having a cylindrical member disposed radially outward of said tubular member, one of said members having a plurality of circumferentially spaced notches and the other of said members having a projection to engage said notches and maintain the handle in a given position, and means for biasing the projection into engagement with said notches.

10. The stamp of claim 9, wherein said projection is on said tubular member and said notches are on the inner surface of said cylindrical member, said biasing means comprising a pair of generally parallel open-ended slots in said tubular member and bordering said projection, said slots providing resiliency for said projection to bias the projection into engagement with said notches.

* * * * *